US012467220B2

(12) United States Patent
Widmann et al.

(10) Patent No.: US 12,467,220 B2
(45) Date of Patent: Nov. 11, 2025

(54) TRENCH CUTTER DRIVE WITH DECOUPLED INNER WHEEL/INTEGRATED BEARING

(71) Applicant: Liebherr-Components Biberach GmbH, Biberach an der Riss (DE)

(72) Inventors: Roland Widmann, Unlingen (DE); Johannes Halder, Ertingen (DE)

(73) Assignee: Liebherr-Components Biberach GmbH, Biberach an der Riss (DE)

( * ) Notice: Subject to any disclaimer, the term of this patent is extended or adjusted under 35 U.S.C. 154(b) by 847 days.

(21) Appl. No.: 17/655,705

(22) Filed: Mar. 21, 2022

(65) Prior Publication Data

US 2022/0205212 A1 Jun. 30, 2022

Related U.S. Application Data

(63) Continuation of application No. PCT/EP2020/075793, filed on Sep. 16, 2020.

(30) Foreign Application Priority Data

Sep. 20, 2019 (DE) ..... 20 2019 105 230.9

(51) Int. Cl.
*E02F 3/24* (2006.01)
*E02D 17/13* (2006.01)
(Continued)

(52) U.S. Cl.
CPC ..... *E02F 3/246* (2013.01); *E02F 3/205* (2013.01); *E02F 5/08* (2013.01); *E02F 5/14* (2013.01)

(58) Field of Classification Search
CPC ..... E02F 3/205; E02F 3/241; E02F 3/246; E02D 17/13; E21C 25/10
See application file for complete search history.

(56) References Cited

U.S. PATENT DOCUMENTS 5,267,902 A * 12/1993 Arzberger ..... E02D 17/13 464/89
6,626,500 B1 * 9/2003 Cribb ..... E02F 3/205 299/41.1

(Continued)

FOREIGN PATENT DOCUMENTS

DE 19539248 4/1996
DE 19539249 4/1996

(Continued)

*Primary Examiner* — Joseph M Rocca
*Assistant Examiner* — Robert E Pezzuto
(74) *Attorney, Agent, or Firm* — Levine Bagade Han LLP

(57) ABSTRACT

The invention relates to a drive device for a construction machine, in particular for a trench cutter, comprising a connection support and a wheel support, which is rotatably supported on the connection support via at least one rolling bearing and which can be rotationally driven relative to the connection support by a drive motor via at least one gear stage, wherein the gear wheel of the gear stage, the wheel being arranged within the connection support and meshing or being in rolling engagement with at least one other gear wheel, is movably and/or tiltably supported in the radial direction relative to the connection support by a flexible and/or movable bearing element so as to be rotationally fixed to the connection support and/or to a bearing shield rigidly connected thereto.

21 Claims, 8 Drawing Sheets

(51) Int. Cl.

| | |
|---|---|
| ***E02F 3/20*** | (2006.01) |
| ***E02F 5/08*** | (2006.01) |
| ***E02F 5/14*** | (2006.01) |

(56) References Cited

U.S. PATENT DOCUMENTS

| | | | | |
|---|---|---|---|---|
| 11,041,282 | B2 * | 6/2021 | Laghi | E02F 3/26 |
| 2008/0296959 | A1 * | 12/2008 | Chagnot | E02F 3/205<br>299/79.1 |

FOREIGN PATENT DOCUMENTS

| | | |
|---|---|---|
| EP | 2597205 | 4/2014 |
| EP | 1666671 | 11/2015 |
| EP | 3467209 | 4/2019 |
| JP | S61-184253 | 8/1986 |
| JP | H04-097019 | 3/1992 |
| JP | 2007-107647 | 4/2007 |
| WO | WO 2018/061134 | 4/2018 |
| WO | WO 2021/052976 | 3/2021 |

* cited by examiner

TRENCH CUTTER DRIVE WITH DECOUPLED INNER WHEEL/INTEGRATED BEARING

CROSS-REFERENCE TO RELATED APPLICATIONS

This application is a continuation of International Patent Application Number PCT/EP2020/075793 filed Sep. 16, 2020, which claims priority to German Patent Application Number DE 20 2019 105 230.9 filed Sep. 20, 2019, the contents of which are incorporated herein by reference in their entireties.

BACKGROUND

The present invention relates to a drive device for a construction machine, in particular in the form of a trench cutter, comprising a connection support and a wheel support, which is rotatably supported on the connection support via at least one rolling bearing and which can be rotationally driven relative to the connection support by a drive motor via at least one gear stage. The invention also relates to a trench cutter having such a drive device.

In case of foundation or surface mining machines, the rotationally drivable work tools are regularly subjected to high forces and impact loads which, on the one hand, have to be absorbed by sufficiently stable bearings and, on the other hand, should not damage the drive train of the drive devices for rotationally driving the work tools. The rotational work tools of such construction machines, such as for example the cutting wheels of a trench cutter or the cutting drum of a Surface-Miner, are usually driven by a drive motor via one or more gear stages to be able to provide the required torque at the work tool at the desired tool speed, wherein at least one gear stage can be arranged at least partially in the interior of a connection support to be able to rotationally drive a wheel support rotatably supported thereon with a work tool attached thereto. In order to enable high step-up or step-down ratios in a small installation space and to be able to transmit high powers, the transmission can comprise at least one planetary gear stage, which can be accommodated in the said wheel support.

On the one hand, such a gear stage inside the wheel support or the connection support that rotatably supports it means that the available installation space is very limited. On the other hand, there arises the problem that impact loads of the work tool, for example in case of hitting a rock or stone during earthworks, are transmitted to the gear stage and can damage it.

In case of trench cutters, there further arises an additional problem that to the cutting wheel drive there has to be attached a plurality of different cutting wheels, varying geometrically in width and diameter. To make this possible, the gear mechanism must fit into the installation space for the smallest cutting wheel, but at the same time be designed for the loads of the widest, largest cutting wheel, which further aggravates the problem of limited installation space or sufficient shock resistance of the gear mechanism.

Trench cutters are generally used in specialist civil engineering to cut trenches in the soil, rock or subsoil which are filled with a slurry containing, for example, concrete to form a diaphragm wall. Trench walls are generally wall constructions in the subsoil made of e.g. concrete, reinforced concrete and similar. To produce such a trench wall, a substantially perpendicular trench that is open to the top is cut using a trench cutter, with the cutting tool being lowered into the soil from above and being guided by a support unit, such as a crawler excavator that is supported on the ground and that is preferably travelable. The trench cutter here typically comprises an elongate, upright cutting frame that is vertically travelably suspended at the support unit and that typically supports a plurality of cutting wheels at its lower end that can be drivable in opposite directions about respective horizontal axes. The drive for rotationally driving the cutting wheels may also be mounted on a lower portion of the cutter frame and may comprise, for example, one or more hydraulic motors capable of driving the cutting wheels, for example, via a chain drive and/or one or more gear stages.

The cutting wheels of such a trench cutter have to be changed regularly and relatively often. On the one hand, the cutting tools, which are arranged circumferentially on the cutting wheels, are subject to heavy wear. In order to avoid the need of changing the many cutting tools individually, the entire cutting wheel is usually dismantled and replaced by another cutting wheel with new cutter chisels. On the other hand, there are used different cutting wheels, each optimized for different soil conditions. Since soil conditions can vary depending on the cutting depth, the cutting wheels are often changed even when cutting a single trench if the soil conditions change as the cutting depth increases. Furthermore, for different trench widths and depths, there are also used various cutting wheels, so that altogether the cutting wheels of a trench cutter need to be replaced quite frequently.

Also, in order to be able to provide sufficient drive lines for wide, large cutting wheels, the gear mechanism must be designed accordingly, which normally requires a correspondingly large installation space, since the performance of a planetary gear mechanism is defined by the available installation space, in particular the diameter. At the same time, however, the installation space must be small enough to allow the installation of smaller cutting wheels, so the available installation space must be used as efficiently as possible.

At the same time, however, it is necessary to ensure that the high forces and impact loads occurring during operation do not lead to premature wear of the gear mechanism. If the forces or impacts that occur are transmitted directly to the gear teeth of the gear stage, the service life is reduced or even premature failure occurs. In this respect this can lead to jamming of the gear teeth and consequently to a failure of the gear mechanism in case the high operating forces deform the structural components surrounding or adjacent to the gear mechanism too much. Jamming can be caused, for example, by ovalization of the ring gear teeth of a planetary gear stage if a structural component surrounding the ring gear teeth is deformed too much, or by axial displacement of the planet carrier or another gear element the compensation of which by gear backlash can no longer be ensured.

If the surrounding or adjacent structural components are sufficiently solid or have increased wall thicknesses, such deformations can be limited, but there is a corresponding reduction in the internal installation space if the external dimensions are also limited, for example, by the requirement to be able to attach narrow, small cutting wheels. Such a reduction in internal installation space then in turn limits the performance of the gear mechanism.

A drive device for the cutting wheels of a trench cutter is shown, for example, in EP 1 666 671 B1, in which the wheel supports carrying the cutting wheels are rotatably mounted on the fixed connection support via two roller bearings. The wheel supports can be driven from a drive shaft via gear stages accommodated in the interior of the mounting beam. The drive shafts pass from above through the bearing shield, to which the mounting beam is rigidly attached, to the gear stages.

A similar drive device for the cutting wheels of a trench cutter is shown in EP 2 597 205 B1, wherein a type of bayonet lock is provided between the wheel support and the cutting wheel in each case, further reducing the installation space available for the gear stages.

SUMMARY

It is therefore the underlying object of the present invention to provide an improved drive device and an improved trench cutter of the initially named kind which avoid disadvantages of the prior art and further develop the latter in an advantageous manner. In particular, loads acting on the rotatable wheel support from the work tools are to be reliably absorbed and the gear stage is to be protected from premature wear or even failure, yet this is not to be achieved by compromising the size of the installation space for the gear stage and thus reducing the performance of the gear stage.

Said task is solved, according to the invention, with a drive device as claimed in claim 1 and a trench cutter as claimed in claim 21. Preferred embodiments of the invention are the subject-matter of the dependent claims.

Therefore, according to one aspect of the present invention, it is proposed to decouple the gear stage driving the wheel support from major impact loads and deformations of adjacent or neighboring structural components. In this case, it is not even aimed to prevent deformations of the adjacent structural components, but rather such deformations are allowed and only their negative effects on the gear stage are prevented by decoupling the gear stage from this, so that overdimensioning and an associated loss of installation space are avoided and special, strength-increasing materials or measures become unnecessary. For this purpose, it is provided that a gear wheel of the gear stage, said wheel being arranged within the connection support and meshing or being in a rolling engagement with at least one other gear wheel, is rotationally fixed to the connection support and/or to a bearing shield rigidly connected thereto, but is supported in a radially movable and/or tiltable manner relative to the connection support by a flexible and/or movable bearing element. By holding the gear wheel in a rotationally fixed manner, the drive power can be transmitted, while the radially flexible and/or tiltable bearing element can compensate for deformations and/or impact loads of the connection support and keep them away from the gear wheel.

In particular, there may be provided a gap between the outer periphery of said fixedly held gear wheel and the inner periphery of the connection support which allows the connection support to deform, for example to ovalize, or to absorb shock loads from the wheel support while preventing such deformations and/or shock loads from the connection support from being transmitted to the gear wheel. The radial spacing of the outer periphery of the gear wheel from the inner periphery of the connection support can also prevent deformation of the gear wheel if the gear wheel or a bearing element connected to it, for example the planet carrier, is meshing or being in rolling engagement with it, since said gear wheel can undergo the axial displacement without being prevented from doing so by the connection support.

Said fixed gear wheel can in particular be the ring gear of a planetary gearbox, which is meshing and/or being in rolling engagement with the planetary gears mounted on a planet carrier. In a multi-stage design of the planetary gear, said ring gear may be in mesh with the planetary gear sets of several planetary stages simultaneously, although multiple, separate ring gears may also be provided for separate planetary gear stages.

The radially flexible and/or elastic bearing element permitting tilting movements can be of different design, for example, it can form a bearing element separate from the gear wheel and connected to the gear wheel in a rotationally fixed manner. Alternatively, however, said bearing element can also be integrally formed in single piece material-homogeneously on the gear wheel.

In particular, said gear wheel may be held at one end face by said bearing element and freely project toward the other, oppositely disposed end face. Such a cantilever-type mounting of the fixed gear wheel allows radial and/or tilting relative movements with minimum clearance and/or installation space, thus achieving decoupling without compromising installation space.

For example, said bearing element may form a bearing flange projecting radially from the body of the gear wheel and projecting outwardly or, if required, inwardly at the end face of the gear wheel. In this case, one end face of said bearing flange can be attached to the connection support and/or a bearing shield rigidly connected thereto.

Such a projecting bearing flange may, for example, be integrally formed in a single piece, homogeneous in material, on the gear wheel and form a bearing shoulder which can be rigidly secured to a confronting surface on the connection support and/or the bearing shield.

The desired flexibility or elasticity of the bearing element can be achieved by sufficiently thin dimensioning or soft adjustment of the material so that the bearing element deforms in itself when deformations of the connection support or impact loads are to be compensated.

As an alternative or in addition to such a flexible bearing flange, said gear wheel can also be mounted in a rotationally fixed manner relative to the connection support by means of a synchronization gearing permitting axial offset, for example a shaft-hub connection with involute toothing.

Such a synchronization gearing can be provided between the gear wheel and the connection support and/or between the gear wheel and the bearing shield.

Advantageously, it can be provided that said synchronization gearing is not provided over the entire length of the gear wheel, but only at a front end section of the gear wheel. In particular, even when such a synchronization gearing is provided at a front end section of the gear wheel, a gap can be provided between the outer periphery of the gear wheel body adjoining it and the connection support inner periphery in order to allow said compensating movements.

An axial lock can prevent undesired axial wandering of the gear wheel along the tooth faces of the synchronization gearing.

Advantageously, said gear wheel is held by the flexible bearing element at its inner end portion facing the bearing shield to which the connection support is rigidly attached. This reduces the effects of deformation due to external forces from the wheel support and reduces the corresponding lever arm. Said flexible and/or movable bearing element may be provided on the end face of the fixedly held gear wheel on the bearing shield side.

By decoupling the bearing of the gear wheel, there can be achieved considerable advantages: First of all, there can be reduced external impacts on the toothed components of the gear stage due to shock loads as well as component deformation, thus reducing the risk of premature gear failure due to gear damage and extending the gearbox service life. At the same time, component jamming due to elastic deformation of the adjacent structural components such as the connection support can be prevented. In addition, axle displacements at other transmission elements of the gear stage can be compensated for in that the flexible or decoupled gear stage yields.

On the other hand, however, the lower external impacts or load compensation can also provide a smaller gear mechanism and reduce the installation space as well as the costs.

Furthermore, the fixed gear wheel can be replaced independently of the connection support, thus avoiding expensive replacement of the connection support when the gear wheel is worn. In addition, cost reduction can also be reduced in manufacturing, as only one heat treatment of the gear wheel may be sufficient.

Nevertheless, in order to make the best possible use of the available installation space inside the connection support and wheel support, or to enlarge it as far as possible without increasing the external dimensions of the wheel support, it is proposed in accordance with a further aspect of the present invention to integrate the at least one rolling bearing, by means of which the wheel support is rotatably mounted on the connection support, at least partially into the wheel support and/or the axle support. To save the radial installation space of separate bearing rings, a bearing raceway on which the rolling elements of the rolling bearing roll can be integrated into the wheel support and/or a raceway can be integrated into the connection support. The raceway can be formed directly by or incorporated into the surface of the wheel support and/or the surface of the connection support. The raceway can be formed integrally, material-homogeneously from the material of the connection support and/or the rotatably mounted wheel support.

In particular, the bearing ring otherwise normally provided can be formed directly from the material of the wheel support and/or the connection support in said manner integrally in one piece, homogeneously in terms of material. Any raceway coatings provided or, depending on the design of the bearing, raceway wires or raceway inserts can still be provided, but are advantageously embedded directly in the material of the wheel support and/or the connection support or applied to it as a coating.

A raceway hardening may be formed by a hardened layer of the wheel support and/or axle support material.

To enable simple assembly despite the integrated design of the raceways, the wheel support can be designed in two or more parts and/or the connection support can be designed in two and/or more parts. Advantageously, a pitch plane can run or be arranged adjacent to a row of rolling elements.

If multiple rows of bearings or multiple rolling bearings are provided, the multiple raceways can advantageously be integrated into a one-piece section of the wheel support and/or the connection support. In this way, positional variations between the raceways and thus the rows of rolling elements can be avoided and uniform introduction of the bearing forces can be achieved.

The at least one rolling bearing can have different configurations with regard to the design and arrangement of the rolling elements. In order to be able to transmit high forces with small dimensions, the rolling elements can be designed as cylindrical or tapered rollers, although at least one row of ball bearings can also be provided. Alternatively or additionally, spherical roller bearings or spherical roller bearings or even needle roller bearings can be provided.

In the case of more than one bearing row, mixed forms can also be provided, for example a ball bearing row and a roller bearing row.

Advantageously, rows of rolling bearings can be provided which are set at an angle and whose main directions of wear can be arranged at an acute angle to one another. In particular, the main wear directions can converge radially outward so that the effective support width increases inward. In particular, the inclined position of the rows of rolling bearings can be configured in such a way that the support width becomes smaller towards the wheel support and larger towards the connection support.

In an advantageous further embodiment of the invention, the arrangement of the at least one rolling bearing may be displaced toward a cantilevered end portion of the connection support and/or displaced from the end portion of the connection support remote from the bearing shield. The rolling bearings are therefore not arranged centrally or symmetrically distributed towards the center of the connection support, but eccentrically displaced towards its end section spaced from the bearing shield.

The rolling bearings integrated into the structural components not only make it possible to gain installation space for the gear stage, but also reduce costs and tend to achieve higher load ratings. In particular, the integrated design of the rolling element bearing raceways results in a compact design for the wheel support bearing arrangement, since the otherwise separate bearing rings can be omitted. At the same time, this allows stiffer structural components and/or larger gear teeth with the same installation space, since on the one hand the wall thicknesses of the structural components can be increased due to the elimination of the bearing rings in their place, and on the other hand the connection support requires less distance from the wheel support and can therefore be made larger.

On the other hand, there are cost advantages, since rolling bearings are very cost-intensive in the required size dimensions and the integrated solution of the bearing raceways can save the costs for the bearing rings.

There is also a tendency to achieve higher load ratings compared to standard rolling bearings.

In order to make the best possible use of the available installation space and to be able to transmit high powers, the at least one gear stage can be a planetary gear stage of a planetary gear, which can be arranged in an inner space enclosed by the connection support and/or wheel support. Such a planetary gear can be of single-stage or multi-stage design, wherein in the case of multi-stage design the multiple planetary gear sets can mesh with a common ring gear.

The rotatable wheel support can be driven by or connected to the planet carrier in a rotationally fixed manner, said planet carrier carrying a planetary gear set.

BRIEF DESCRIPTION OF THE DRAWINGS

The invention will be explained in more detail in the following with respect to preferred embodiments and to associated drawings. The drawings show.

DETAILED DESCRIPTION

Figure 1:
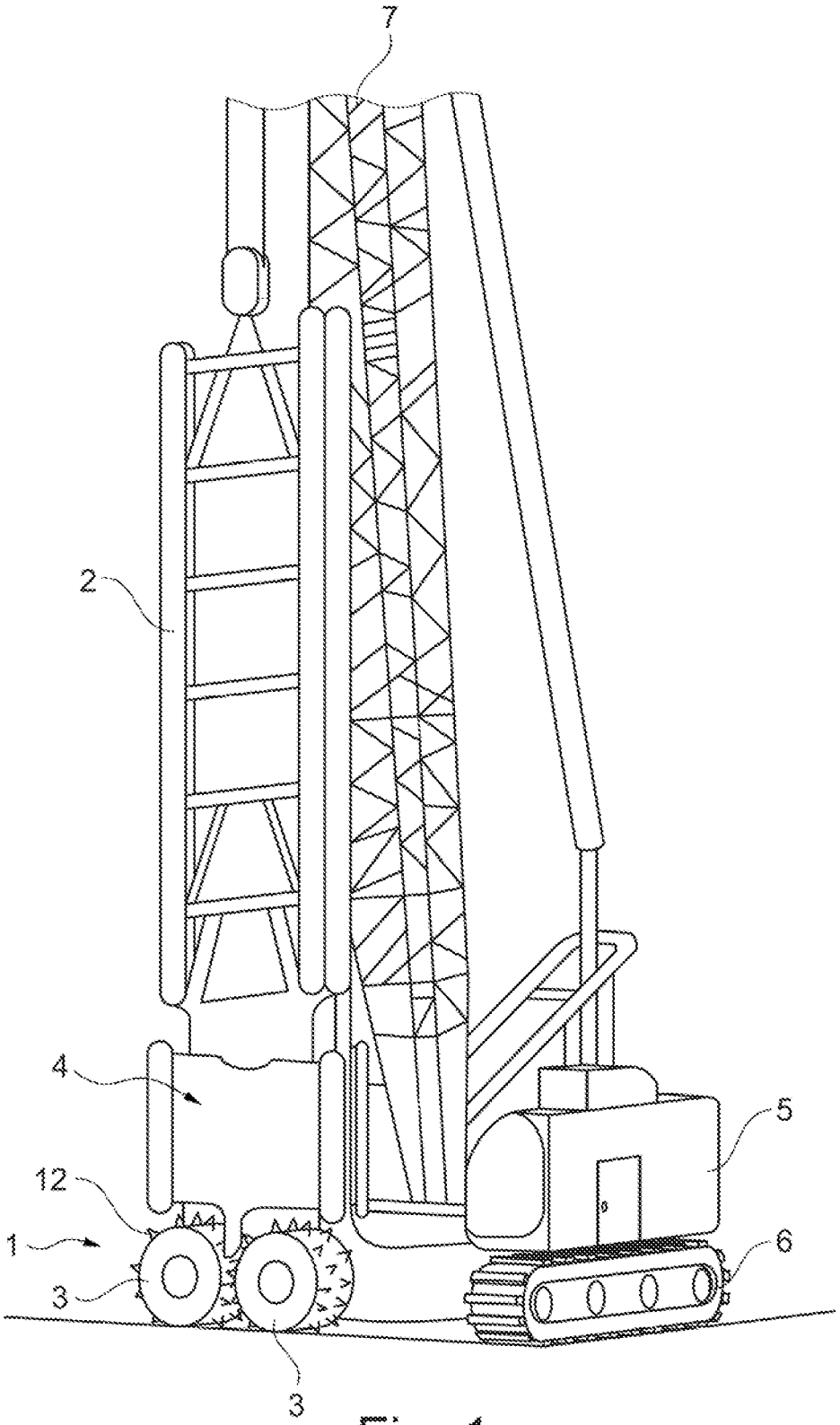
FIG. 1: illustrates a schematic, perspective view of a trench cutter according to an advantageous embodiment of the invention.
Figure 2:
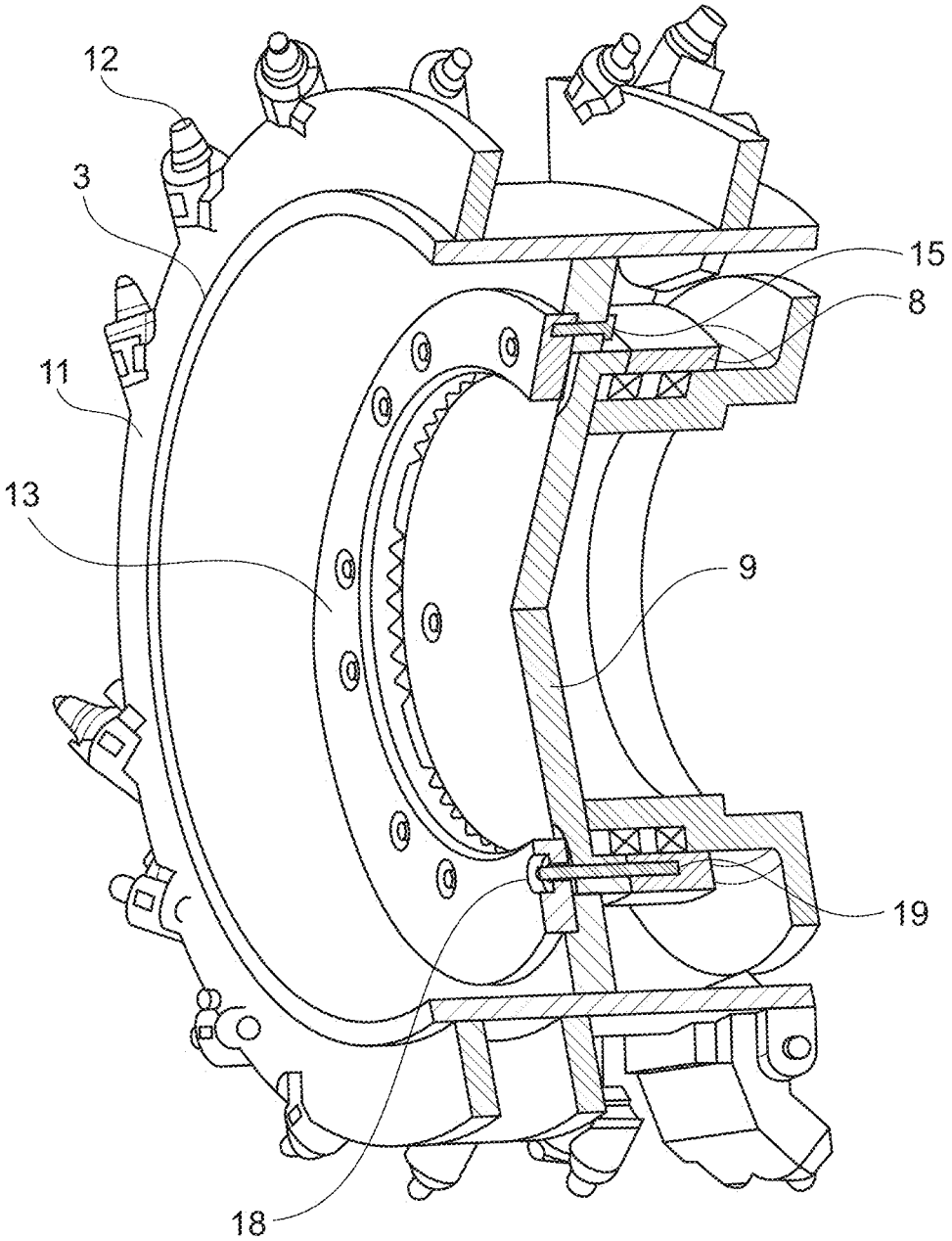
FIG. 2: illustrates a perspective, partially sectional view of a cutting wheel, the wheel support supporting the cutting wheel and the connection support supporting the wheel support, the partial sectional view showing said components in the assembled state.

As shown in FIG. 1, as an example of a foundation mining machine, a trench cutter 1 may have an elongated, upright cutter frame 2, which may be in the form of a beam and/or may comprise two laterally arranged longitudinal guide profiles. At a lower end portion, the cutter frame 2 may have at least two cutting wheels 3 which are arranged side by side and may be rotationally drivable about respective lying axes of rotation, wherein the axes of rotation of the cutting wheels 3 may extend parallel to each other, in particular perpendicular to the flat side of the cutter frame 2.

In this respect, the two cutting wheels 3 can be driven in opposite directions to each other. A cutter drive 4 may be arranged at a lower end portion of the cutter frame 2 above the cutting wheels 3 and may comprise, for example, one or more hydraulic motors capable of driving said cutting wheels 3 via one or more gear stages.

As shown in FIG. 1, the cutter frame 2 with the cutting wheels 3 can be raised and lowered by, or suspended from, a basic machine 5. Said basic machine 5 rests on the ground in which the respective trench is to be cut, and may advantageously be configured to be movable. In particular, the basic machine 5 may be a cable excavator having a chassis, for example a tracked chassis 6, wherein the cutter frame 2 may be raised and lowered by an boom 7 of the basic machine 5.

As FIGS. 2 to 5 show, each cutting wheel 3 is attached to a cutter hub 8, which is rotatably mounted on the cutter frame 2 and can be driven by the cutter drive 4. The cutter hub 8 can be formed by the output element of the cutter drive 4 or an interposed gear stage. In particular, said gear stage can be configured as a planetary gear, whereby the cutter hub 8 can, for example, be formed by a planet carrier of the planetary gear.

Said cutter hub 8 comprises a wheel support 9, for example of pot-shaped design, which is rotatably mounted on a connection support 20 and has an end face 10 against which the respective cutting wheel 3 can be clamped.

The cutting wheel 3 can be constructed in the manner of a rim and, independently of this, have a peripheral wall 11, on the outside of which one or more rows of cutting tools 12 can be arranged, for example in the form of cutter chisels. Said peripheral wall 11 is rigidly connected to a mounting flange 13, which may be in the form of a disk or ring and independently has a face 14 that can be placed against the face 10 of the cutter hub 8. Said mounting flange 13 may extend approximately in a plane perpendicular to the axis of rotation and have a flat face 14 facing the cutter hub 8.

Advantageously, said mounting flange 13 is detachably attached to the rest of the body of the cutter wheel 3 so that it can be replaced when worn. For example, the mounting flange 13 may be attached to the body of the cutting wheel 3 by means of a plurality of screws 15.

Figure 3:
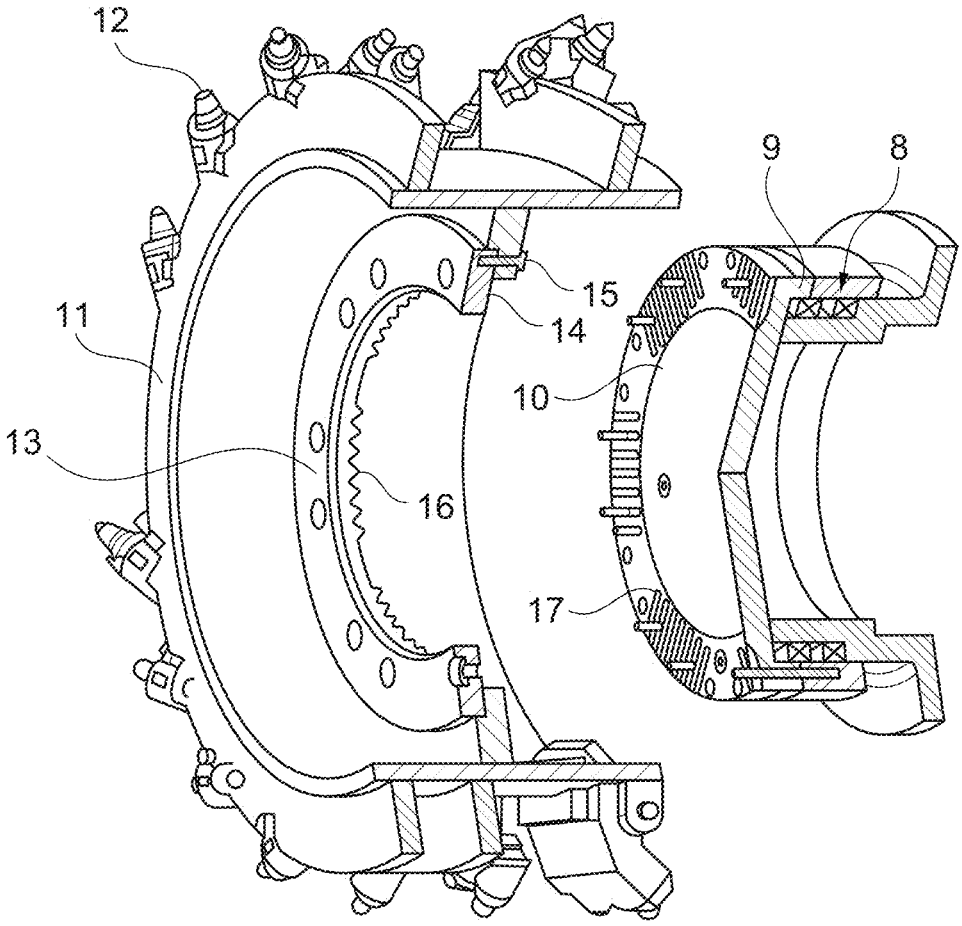
FIG. 3: illustrates a perspective, partially cutaway view of the cutting wheel, the wheel support and the connection support, the cutting wheel and the wheel support being shown in the disassembled state.
Figure 5:
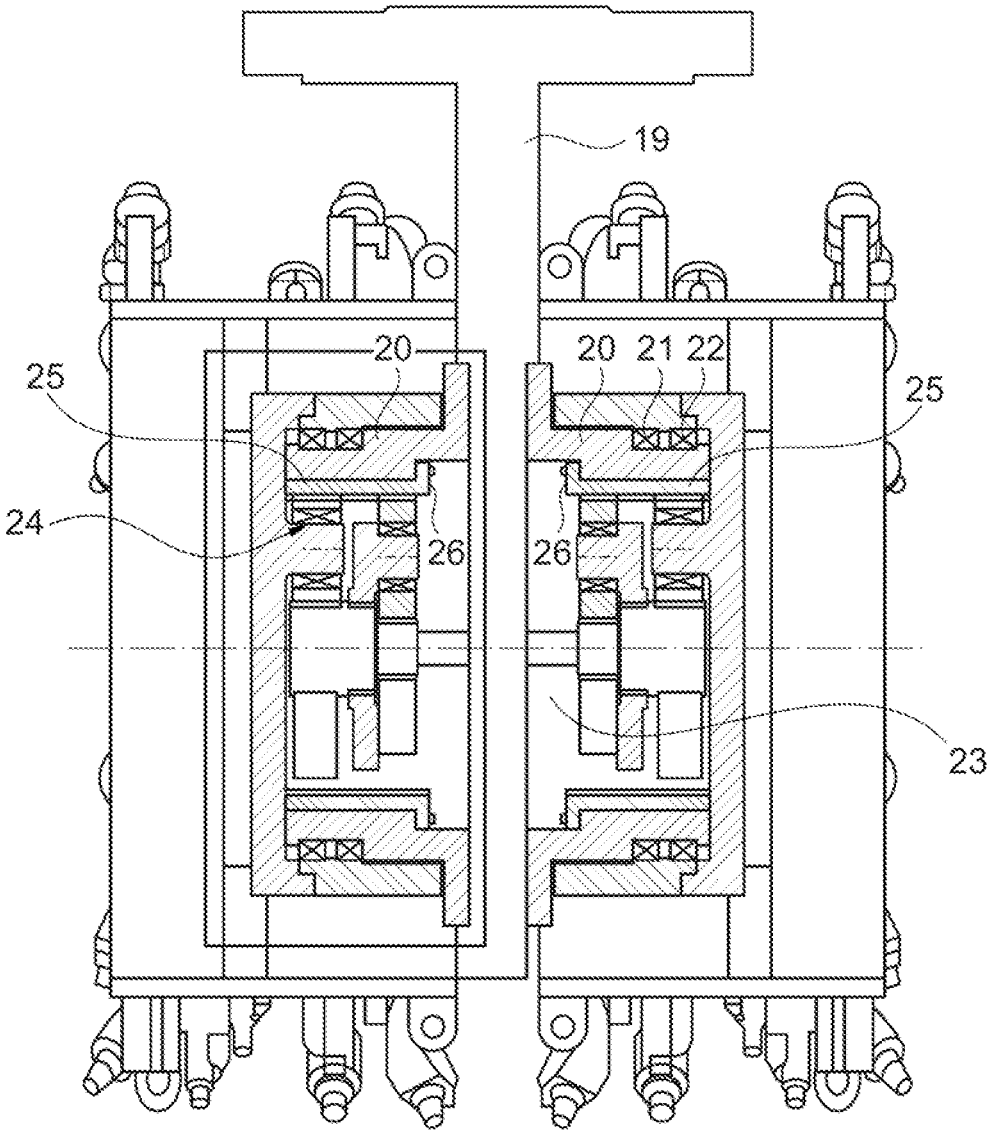
FIG. 5: illustrates a sectional view through the drive unit of FIG. 4, showing the gear stages accommodated in the connection supports and the internal or hollow toothed gears of the gear stages fixed flexibly to the respective connection support.

As FIG. 3 shows, the face sides 10 and 14 of the cutter hub 8 and the cutter wheel 3, which can be placed against each other, are each provided with a face toothing 16, 17, which are configured and arranged to fit each other positively, so that the two face toothings 16 and 17 come into mesh with each other when the face sides 10 and 14 of the cutter hub 8 and the cutter wheel 3 are placed against each other. In this respect the face toothings 16 and 17 are configured in such a way that they engage with each other by simply sliding the cutting wheel 3 and cutter hub 8 axially onto each other parallel to the axis of rotation. If the two face toothings 16 and 17 are positioned on top of each other so that they mesh, as shown in FIG. 5, the cutting wheel 3 is positively and rotationally fixed to the cutter hub 8.

The cutting wheel 3 can thereby be clamped axially against the cutter hub 8 by axial clamping means, which can advantageously comprise several screw bolts, in order to secure the cutting wheel 3 on the cutter hub 8 and to hold the face toothings 16 and 17 in positive engagement. As FIG. 3 shows, a plurality of screw bolts can be arranged distributed in the circumferential direction, in particular in the area of the face toothings 16 and 17, in order to fix the face toothings 16 and 17 uniformly in the engaged position.

As FIG. 3 shows, the face toothings 16 and 17 can each have a plurality—in the version shown, 6-groups of teeth, which can be spaced apart from one another in the circumferential direction and evenly distributed, or, if necessary, unevenly distributed. In particular, the tooth groups can be arranged on a common pitch circle and separated from each other by toothless surfaces.

As FIG. 3 shows, each tooth group can have a plurality of teeth, each of which can have straight tooth faces, wherein all tooth faces of a tooth group can be arranged parallel to each other, while the tooth groups can be twisted relative to each other or aligned in different directions. In particular, a respective central tooth of a respective tooth group can extend in the radial direction with respect to the axis of rotation and be flanked on the right and left in each case by teeth arranged parallel thereto.

Figure 4:
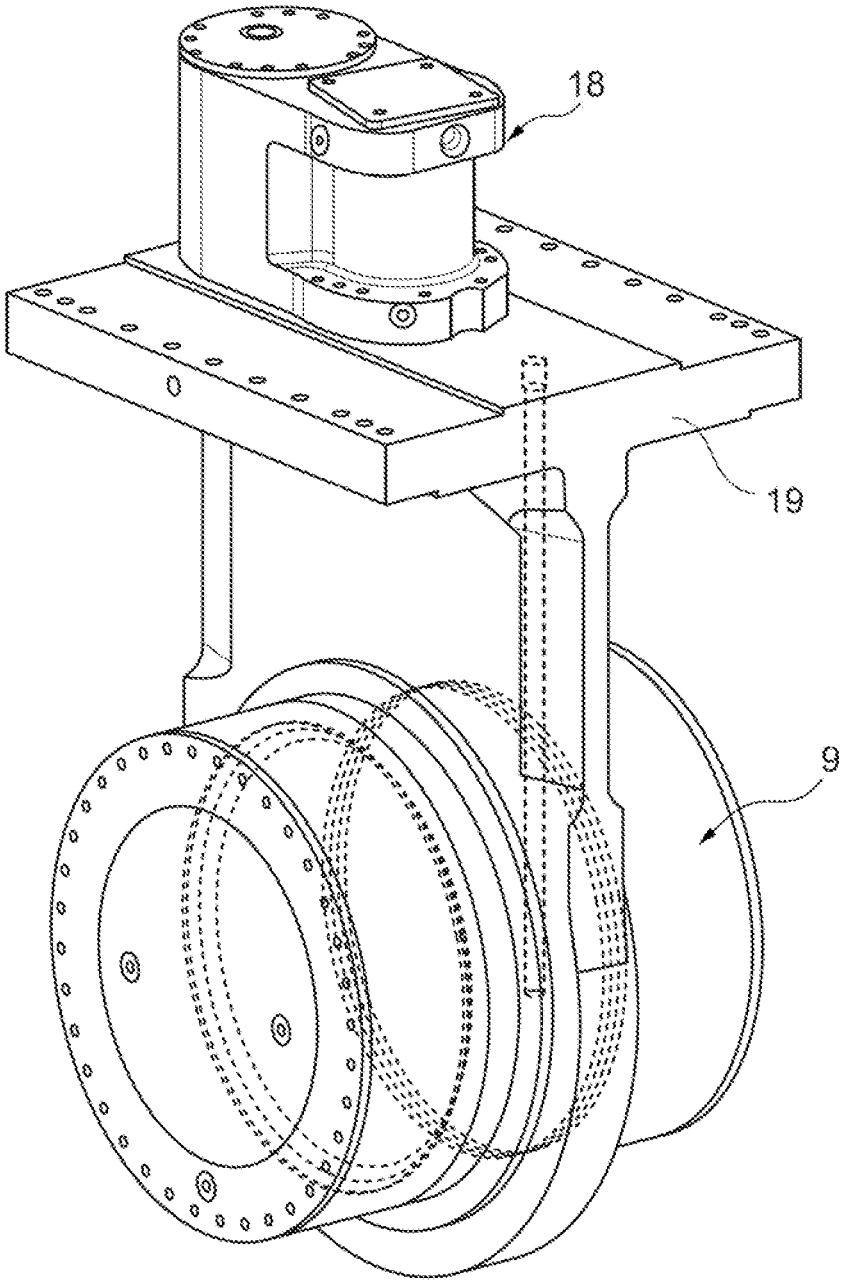
FIG. 4: illustrates a perspective view of the drive unit of the trench cutter from FIG. 1, showing the two wheel supports each mounted on connection supports, the bearing shield supporting them and the drive motor at an upper end section of the bearing shield.

As FIG. 4 shows, two wheel supports 9 may be arranged at oppositely disposed sides of a bearing shield 19, which bearing shield 19 may comprise a substantially plate-shaped upright shield section, at the lower end portion of which the wheel supports 9 are rotatably mounted. A drive motor 18, for example in the form of a hydraulic motor, may be arranged at the upper end of the bearing shield 19 to drive the wheel supports 9 in rotation, as will be explained.

As FIG. 5 shows, connection supports 20 are rigidly attached to opposite sides of the bearing shields 19 and may be substantially sleeve-shaped or cylindrical. Said wheel supports 9, which may be pot-shaped, can be slipped over the said connection supports 20, as shown in FIG. 5.

Said wheel support 9 is thereby rotatably and axially fixedly supported on the connection support 20 by two rolling bearings 21, 22, as will be explained in more detail.

In the interior space bounded by the connection support 20 and the wheel support 9, which is bounded at the end face on the one hand by the bearing shield 19 and on the other hand by the base of the pot-shaped wheel support, a gear mechanism 24 is arranged via which the wheel support 9 is driven in rotation by the drive motor 18. In this case, the gear mechanism 24 is driven on the input side by a drive shaft which can extend through the bearing shield 19 and connects the drive motor 18 to the gear mechanism 24.

Said gear mechanism 24 may be configured in particular as a planetary gear, which, as the figure shows, may have multiple stages. In this case, the drive motor 18 can drive a sun gear of the first planetary stage via said drive shaft. The planetary gears meshing with said sun gear, which are rotatably mounted on a planet carrier, may mesh with a ring gear 25, which is fixed to the connection support 20 and/or the bearing plate 19 for rotation, but is radially and tiltably flexibly mounted, as will be explained.

Said ring gear 25 may also simultaneously form the ring gear of the second planetary stage and mesh with its planetary gears. The planetary gear carrier of the second planetary stage may be connected in a rotationally fixed manner to the wheel support 9, for example rigidly connected to the bottom of the pot-shaped wheel support 9, cf. FIG. 5.

In order to decouple the gear 24, in particular its ring gear 25, from impact loads and deformations of the connection support 20, although said ring gear 25 is rotationally fixed to the connection support 20, a flexible and/or elastic bearing element 26 is provided which holds said ring gear 25 rotationally fixed to the connection support 20 or, if necessary, can also hold it to the bearing shield 19, but allows radial compensating movements and/or tilting movements and/or deformations of the connection support 20 without transmitting them to the ring gear 25.

Figure 6:
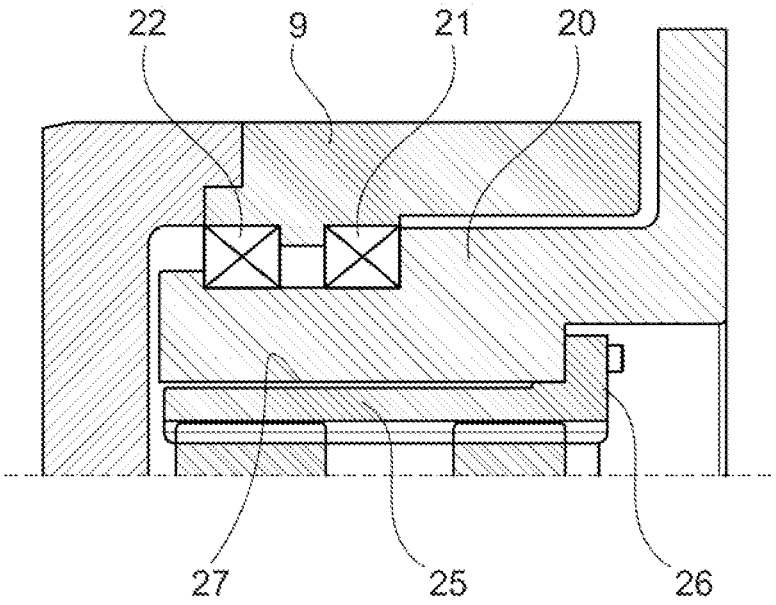
FIG. 6: illustrates a sectional enlarged view of the arrangement and resilient mounting of said hollow toothed gear of a gear stage inside the connection support.

As FIG. 6 shows, the bearing element 26 can be firmly connected to the ring gear 25 at a front end section of the ring gear 25, for example integrally formed thereon in one piece, homogeneous in terms of material.

Independently thereof, the bearing element 26 can form a radially projecting bearing flange which can abut against and/or be attached to opposing surfaces on the end face and/or circumferentially on the connection support 20 and/or can be attached to matching opposing surfaces on the bearing shield 19.

As FIG. 6 shows, the flange-like bearing element 26 can be seated on a shoulder of the connection support 20 and can be fastened thereto in a rotationally fixed manner or rigidly fastened thereto, for example, using clamping means which can be in the form of screws. The connection between the bearing element 26 and the connection support 20 may itself be rigid if the bearing element 26 is inherently flexible and/or elastic and/or the connection of the bearing element 26 to the ring gear 25 is flexible and/or elastic. Such sufficient flexibility and/or elasticity can be achieved, for example, by the bearing element 26 and/or the connecting portion to the ring gear 25 being sufficiently thin and/or the material of the bearing element 26 being set sufficiently soft.

As FIG. 6 shows, a gap 27 may be provided between the outer periphery of the ring gear 25 and the inner periphery of the connection support 20 to allow relative radial movements and/or tilting movements between the ring gear 25 and the connection support 20. The connection support 20 can also deform, for example ovalize under external loads, without this being transmitted to the ring gear 25, since such deformations can be compensated for by the gap 27.

Advantageously, the gap 27 may extend substantially along the entire axial length of the ring gear 25 and/or along the entire radial overlap—that is, in the region in which the ring gear 25 and the connection support 20 overlap in the radial viewing direction—for example, over more than 75% or more than 90% of said axial length.

The gap dimension of the gap 27 can be dimensioned differently, for example in the range of a few millimeters or tenths of a millimeter.

Advantageously, the ring gear 25 can be supported at only one axial end section and/or attached to the connection support 20 or the bearing shield 19 and project freely toward the opposite end face, similar to what is known from cantilever suspensions. A bearing provided on one end portion only allows the ring gear 25 to make radial and/or tilting compensating movements relative to the connection support.

Advantageously, an inner end portion of the ring gear 25 may be supported by the bearing member 26, the inner end portion facing the bearing shield 19. This shortens relevant lever arms and reduces the impact of loads acting from the outside. In particular, in this way shock loads introduced by the pot-shaped wheel supports 9 via the planet carrier connected to them can also be well cushioned by the ring gear 25 or compensated for by the compensating movements described.

According to a further aspect, in order to gain installation space when the outer dimensions of the wheel support 9 are limited and to enlarge said inner space 23 within the connection support 20 as much as possible, it may be provided that the rolling bearings 21 and 22 by means of which the wheel supports 9 are rotatably mounted on the connection supports 20 are integrated into the respective wheel support 9 and/or the respective connection support 20. In particular, the bearing rings of conventional rolling bearings can be dispensed with and the rolling elements 28 can run on raceways 29 and 30 that are integrated into the wheel support 9 and the connection support 20. If necessary, it can also be helpful if only one of the raceways is integrated in the wheel support 9 or in the connection support 20. However, in order to create as much installation space as possible, both raceways 29 and 30, i.e. the inner and outer raceway of a rolling bearing row, can advantageously be integrated into the wheel support 9 and the connection support 20, cf. FIG. 8 and FIG. 9.

Said raceways 29 and 30 are thereby at least partially formed by the surface of the wheel support 9 or the connection support 20, where a specially hardened raceway coating may be applied and/or a special raceway element such as a raceway wire may be incorporated. Alternatively or additionally, the surface of the wheel support 9 and/or the connection support 20 forming said raceway 29 or 30 may be surface-hardened, for example nitride-hardened or otherwise subjected to a hardening process.

Figure 8:
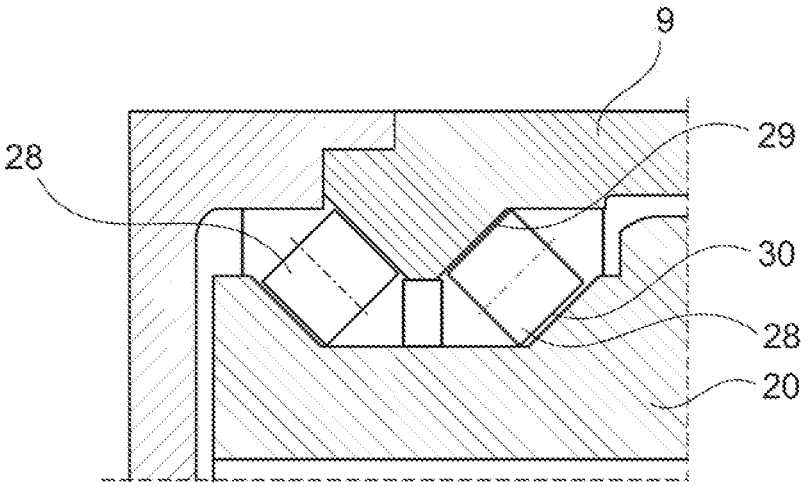
FIG. 8: illustrates an enlarged sectional view through the rows of rolling bearings for the rotatable mounting of a wheel support according to an advantageous embodiment of the invention, according to which the raceways of the rolling elements designed as rollers are integrated in the wheel support and in the connection support, and FIG. 9. a sectional cross-sectional view of the rolling bearing rows similar to FIG. 8, wherein the rolling elements in this embodiment are designed as a ball.

As FIG. 8 shows, the rolling elements 28 can be rollers, for example cylindrical rollers. Alternatively, ball bearings can also be provided, the groove-shaped raceways of which can be integrated in the wheel and connection supports 9 and 20, respectively, as shown in FIG. 9.

Advantageously, the raceways 29 and 30 can be set at an angle in order to be able to transmit not only radial bearing forces but also axial bearing forces.

In particular, two X-shaped or O-shaped inclined bearing rows can be provided, whose main direction of wear is inclined at an acute angle to the radial direction. For example, an opposing inclination of the main removal direction can be provided, which reduces the support width on the outside of wheel support 9 and widens it on the inside of connection support 20, cf. FIG. 8 and FIG. 9.

Figure 9:
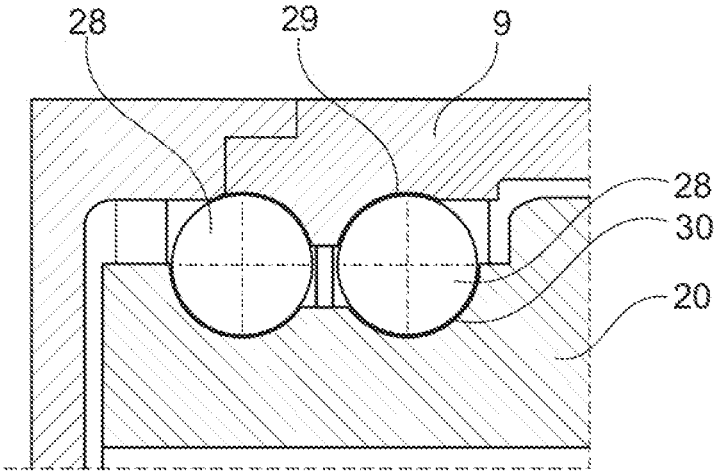

As shown in FIGS. 8 and 9, the rolling elements 28 may be guided by rolling element cages 31 in the circumferential direction and/or transversely thereto.

Figure 7:
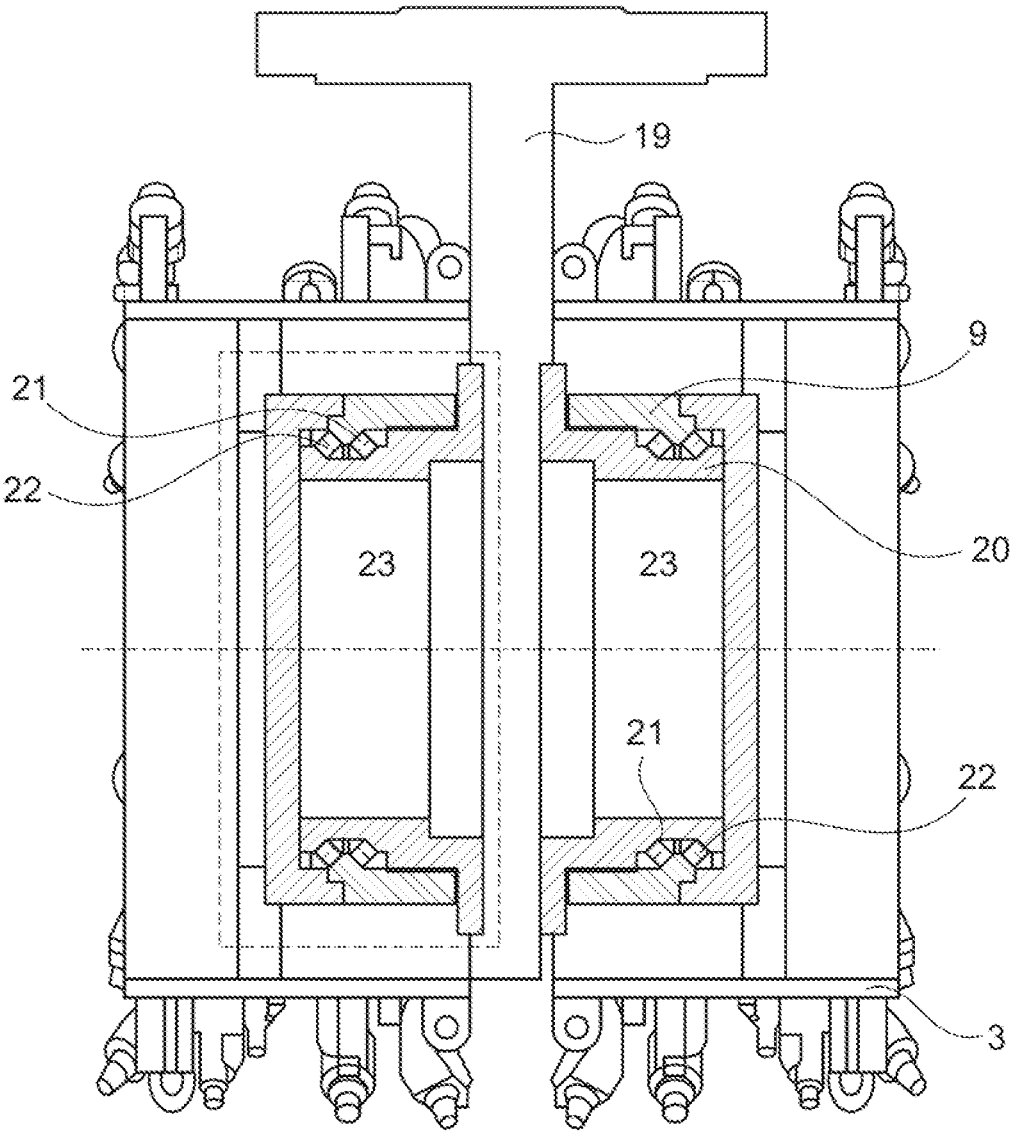
FIG. 7: illustrates a sectional view through the drive unit of FIG. 4 in a representation similar to FIG. 5, with the gear stages inside the connection supports omitted and the roller bearings for rotatably supporting the wheel supports on the connection supports shown.

The wheel support 9 can be of two-part or multi-part design, wherein a parting plane 32 can be arranged adjacent to the rolling bearings 21 and 22, cf. FIGS. 7 to 9. Advantageously, the parting plane 32 can be arranged on an outer side of the two rolling bearings 21 and 22, so that both rolling bearings 21 and 22 or their raceways 29 are arranged on an integrally formed section of the wheel support 9, cf. FIG. 8 and FIG. 9. If necessary, the parting plane 32 could also be provided on an inner side of the two rolling bearings 21 and 22. Advantageously, however, the parting plane 32 is on the outside, i.e. on the side of the two rolling bearings 21 and 22 facing away from the bearing shield 19, so that the outer part of the wheel support 9 can be formed by the planetary gear carrier of the gear 24, or said planetary gear carrier and the wheel support part formed by it can be removed to the outside. This greatly facilitates the assembly of the gear mechanism.

As FIG. 7 shows, the two rolling bearings 21 and 22 may be eccentrically displaced out of an axial center of the connection support 20 and/or arranged closer to one end portion of the connection support 20 than to the opposite other axial end portion. In particular, the rolling bearings 21 and 22 can be arranged displaced towards an outer end section of the connection support 20 facing away from the bearing shield 19, as shown in FIG. 7.

We claim:

1. A drive device for a construction machine comprising a trench cutter, wherein the device comprises:

a connection support;

a wheel support rotatably supported on the connection support via at least one rolling bearing, and wherein the wheel support is configured to be rotationally driven relative to the connection support by a drive motor via at least one gear stage comprising a ring gear;

wherein the ring gear is arranged within the connection support, wherein the ring gear is movably and tiltably supported in a radial direction relative to the connection support by a flexible bearing element so as to be rotationally fixed to the connection support, wherein the flexible bearing element holds the ring gear rotationally fixed to the connection support and allows moving and tilting in the radial direction relative to the connection support.

2. The drive device of claim 1, wherein a gap is between an outer periphery of the ring gear and an inner periphery of the connection support.

3. The drive device of claim 2, wherein the gap extends over more than 75% of an axial length of the ring gear.

4. The drive device of claim 1, wherein the ring gear is held at one end face section by the bearing element and is configured to project freely towards an opposite end face section.

5. The drive device of claim 1, wherein the bearing element is rigidly fixed to the connection support, wherein the bearing element and a connecting portion between the bearing element and the ring gear is configured to be flexible and elastic.

6. The drive device of claim 1, wherein the bearing element is integrally formed in a single piece, material-homogeneously on the ring gear.

7. The drive device of claim 1, wherein the bearing element forms a bearing flange projecting radially from a body of the ring gear, which bearing flange abuts with an end face against an opposing surface on the connection support and is attached thereto.

8. The drive device of claim 1, wherein the ring gear is supported only at its inner end portion facing a bearing shield.

9. The drive device of claim 1, wherein the ring gear is in mesh with planetary gears of a planetary gear stage.

10. The drive device of claim 1, wherein the ring gear is in mesh with planet gears of a plurality of planetary gear stages connected in series.

11. The drive device of claim 9, wherein the wheel support is fixedly connected to a planet carrier of the planetary gear stage, wherein the planet carrier is formed by a bottom of the wheel support.

12. The drive device of claim 1, wherein the wheel support is formed in two or more parts and comprises a wheel support part connected to the gear stage and a wheel support part rotatably supported on the connection support by the at least one rolling bearing, wherein the two wheel support parts are connected to one another in a rotationally fixed manner.

13. The drive device of claim 1, wherein the at least one rolling bearing comprises at least one raceway integrated in the wheel support or in the connection support.

14. The drive device of claim 13, wherein inner and outer raceways of the at least one rolling bearing are integrated in said wheel and connection supports, and are formed by surfaces of said wheel and connection supports.

15. The drive device of claim 14, wherein the wheel support has a surface hardening in a region of the raceway integrated therein.

16. The drive device of claim 15, wherein the at least one rolling bearing comprises one or more rolling bearings, wherein the wheel support is rotatably mounted on the connection support by the one or more rolling bearings, where the one or more rolling bearings have obliquely set raceways with main wear directions inclined at an acute angle to the radial direction.

17. The drive device of claim 16, wherein the the one or more rolling bearings are obliquely set such that a center width on the wheel support is smaller than a center width on the connection support.

18. The drive device of claim 17, wherein the one or more rolling bearings are arranged displaced with respect to an axial center of the connection support towards a front end portion of the connection support.

19. The drive device of claim 18, wherein the one or more rolling bearings are arranged displaced towards an outer end portion of the connection support facing away from a bearing shield.

20. The drive device of claim 19, wherein rolling elements of the one or more rolling bearings are configured as rollers.

21. A trench cutter having a drive device configured according to claim 1 for driving at least one cutter wheel.

* * * * *